US006030102A

United States Patent [19]

Gromotka

[11] Patent Number: 6,030,102

[45] Date of Patent: Feb. 29, 2000

[54] TRIM RETENTION SYSTEM FOR RECESSED LIGHTING FIXTURE

[75] Inventor: Gabriel P. Gromotka, Hanover Park, Ill.

[73] Assignee: Cooper Technologies Company, Houston, Tex.

[21] Appl. No.: 09/220,679

[22] Filed: Dec. 23, 1998

[51] Int. Cl.[7] ..... F21S 3/02

[52] U.S. Cl. ..... 362/365; 362/364; 362/440

[58] Field of Search ..... 362/147, 364, 362/365, 366, 404, 396, 440, 449, 287

[56] References Cited

U.S. PATENT DOCUMENTS

| | | | |
|---|---|---|---|
| 1,029,356 | 6/1912 | Frederick | 362/440 |
| 1,225,700 | 7/1917 | Collins | 362/440 |
| 4,290,098 | 9/1981 | Pierson | 362/267 |
| 4,566,057 | 1/1986 | Druffel | 362/364 |
| 4,670,822 | 6/1987 | Baker | 362/226 |
| 4,760,510 | 7/1988 | Lahti | 362/365 |
| 4,872,097 | 10/1989 | Miller | 362/226 |
| 4,930,054 | 5/1990 | Krebs | 362/149 |
| 4,972,339 | 11/1990 | Gabrius | 362/366 |
| 5,073,845 | 12/1991 | Aubrey | 362/226 |
| 5,222,800 | 6/1993 | Chan et al | 362/147 |
| 5,374,812 | 12/1994 | Chan et al. | 220/3.6 |
| 5,398,179 | 3/1995 | Pacheco | 362/364 |
| 5,452,816 | 9/1995 | Chan et al. | 220/3.8 |
| 5,581,448 | 12/1996 | Harwood | 362/147 |
| 5,588,737 | 12/1996 | Kusmer | 362/148 |
| 5,597,234 | 1/1997 | Winkelhake | 362/364 |
| 5,662,413 | 9/1997 | Akiyama | 362/365 |
| 5,738,436 | 4/1998 | Cummings et al. | 362/294 |
| 5,758,959 | 6/1998 | Sieczkowski | 362/365 |
| 5,800,051 | 9/1998 | Grampe et al. | 362/348 |
| 5,826,970 | 10/1998 | Keller et al. | 362/147 |

*Primary Examiner*—Y. Quach
*Attorney, Agent, or Firm*—Fish & Richardson P.C.

[57] ABSTRACT

A lighting fixture includes a housing, a trim body, and at least one wireform spring attached to the trim body at two points. The housing has an open end defining an inner groove. The wireform spring has a central portion that is designed to fit in the groove when the trim body is attached to the housing.

25 Claims, 8 Drawing Sheets

FIG. 5
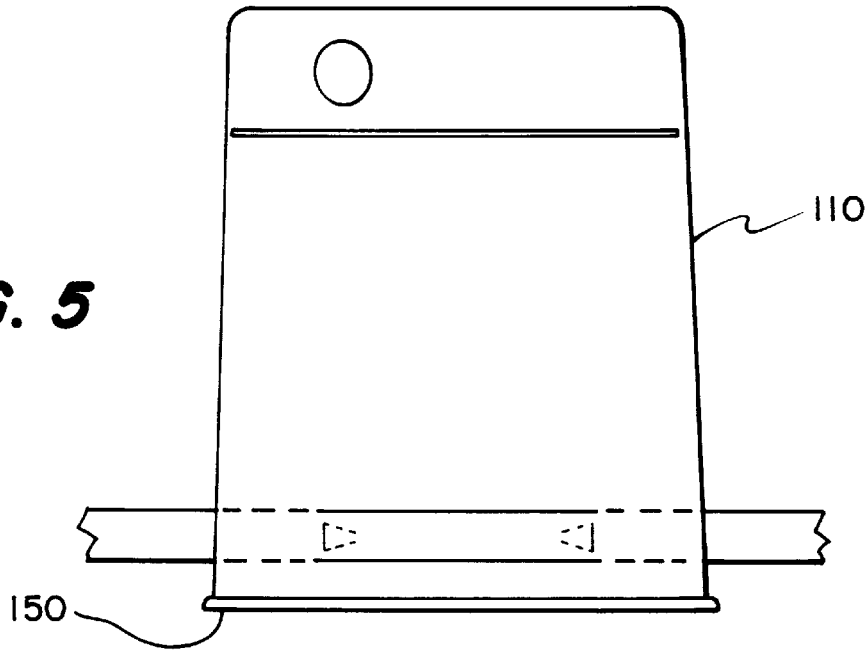
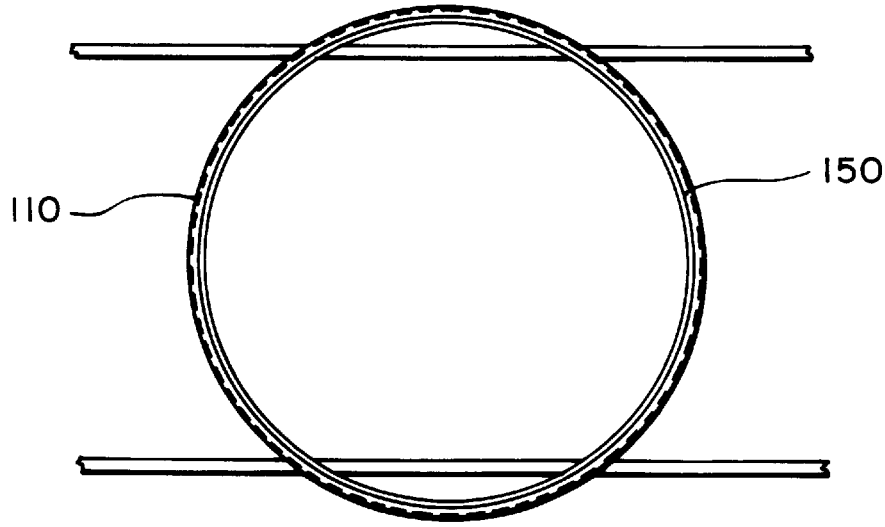
FIG. 6
FIG. 7
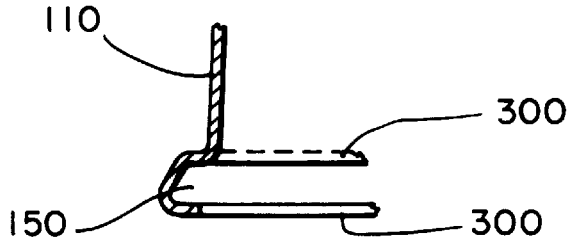

TRIM RETENTION SYSTEM FOR RECESSED LIGHTING FIXTURE

TECHNICAL FIELD

The invention relates to retaining trim in recessed lighting fixtures.

BACKGROUND

A typical recessed lighting fixture often includes three major components: a housing, decorative trim, and a junction box. The housing, which is installed in the ceiling between floor joists, provides means for installation of, and a chamber to house a socket and a lamp.

The trim has a decorative function in that it covers the front of the fixture and any imperfections in the opening of the ceiling. The trim also may serve more practical functions. For example, the trim may serve to protect the lamp, to hold and direct the lamp, to create a desired lighting pattern, and to form an insulating seal between the environment in the room and the space above the ceiling.

A common approach to attaching the trim to the housing uses two extension springs attached to the trim and having hooks on their ends. To install the trim, the springs are extended and the hooks are attached to receptacles inside the housing. Subsequent contraction of the extended springs pulls the trim against the ceiling.

Another approach uses torsion springs attached to the trim. The springs are compressed and their legs are placed in receptacles within the housing. Expansion of the torsion springs exert an upward force on the trim.

A third approach uses friction to keep the trim in the housing. Springs, such as leaf springs, mounted on the trim exert radial force on the lamp housing to keep the trim in place. This approach also may employ sharp barbs on the springs, trim, or housing to further secure the trim.

The junction box provides a location to connect the wires of the lighting fixture to the supply wires that provide power to the lamp. Junction boxes typically are placed adjacent to the housing, and also may be mounted on the side of the housing. Wires pass from the junction box to the lamp socket in the housing.

SUMMARY

In one general aspect, a lighting fixture includes a housing, a trim body, and at least one wireform spring attached to the trim body at two points. The housing has an open end defining an inner groove. The wireform spring has a central portion configured to fit in the groove when the trim body is attached to the housing.

Embodiments may include one or more of the following features. For example, the central portion of the wireform spring may include an outer bend slidably installed in the groove. The wireform spring may include two ends and the trim body may include two holes, with each end of the spring inserted into one of the holes. Other connection approaches also may be used. For example, the trim body may include a pair of posts and the spring ends may include loops that fit over the posts.

The wireform spring may be configured to pivot between a mounting position and an installed position. The spring may be compressed when moving from the mounting position to the installed position. The spring may be most compressed at a point between the mounting position and the installed position. When the spring is in the installed position, it may continue to be compressed so that it exerts a force that pulls the trim body into the housing.

The lighting fixture may include a reflector attached to the trim body. Two wireform springs may be attached to the reflector and installed in the groove when the trim body is attached to the housing. The housing may be generally cylindrical. The open end of the housing may have an irregular shape.

The groove may extend along an entire inner perimeter of the open end or only a portion of the inner perimeter of the open end. The groove may have a diameter that is greater than an inside diameter of the housing, and may be defined by a pair of shoulders.

The light fixture also may include a closed end, a movable dividing plate, and a release mechanism. The dividing plate may be positioned between the closed end and the open end to define a light compartment extending from the open end to the plate and a wiring compartment extending from the plate to the closed end. The release mechanism may be configured to release the plate to permit access to the wiring compartment. The lighting fixture may be a recessed lighting fixture and a light socket may be installed in the housing.

The trim retention system offers the considerable advantage of providing a simple structure that serves the dual function of retaining the trim in the housing and permitting rotation of the trim. This simple, low-cost structure promises to substantially reduce costs associated with these functions. These cost reductions are provided even when rotation of the trim is not required.

The trim retention system also offers the considerable advantage of being easy to install relative to conventional systems, such as those that involve expanding springs with hooked ends to retain the trim against the ceiling. For example, the installer's hands do not need to be inside the housing to install the trim, and no tools are necessary. The trim also is easily removed without causing any damage to the components of the trim retention system, housing, or trim.

In addition, by eliminating springs with sharp hooked ends, the trim retention system provides improved safety. When such springs are in an expanded state during installation, there is potential for them to accidently spring loose and cause injury.

Other features and advantages will be apparent from the following description, including the drawings, and from the claims.

DESCRIPTION OF THE DRAWINGS

FIGS. 5 and 6 are front and bottom views of a housing of the fixture of FIG. 1.

FIG. 7 is an enlarged view of a groove of the housing of FIG. 6.

DESCRIPTION

Figure 1:
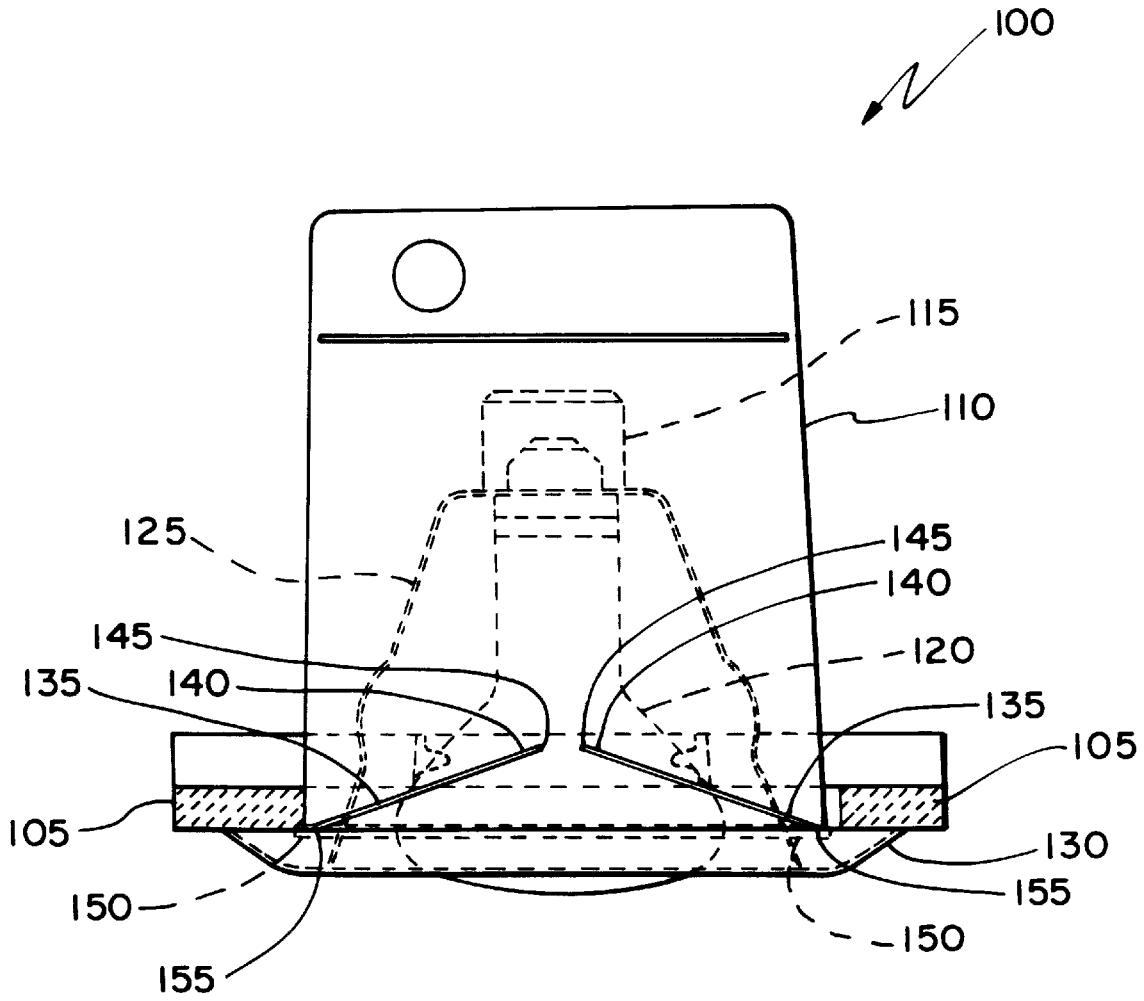
FIG. 1 is a cross-sectional front view of a recessed lighting fixture.

Referring to FIG. 1, a recessed lighting fixture 100 installed in a ceiling 105 includes a housing 110. The housing 110 is generally cylindrical in shape, with a diameter gradually increasing from the top to the bottom. Typically, the housing 110 is made from unfinished metal. A lamp socket 115, in which a lamp 120 may be installed, is secured within the housing.

A reflector 125 is removably and rotatably positioned within the housing. The reflector 125 includes a trim body 130 that extends from the housing to cover a housing opening in the ceiling. The trim body 130 may define an irregularly shaped opening such that the rotational orientation of the trim body affects a pattern of light produced by the fixture. Typically, the reflector is made from painted metal.

Figure 2:
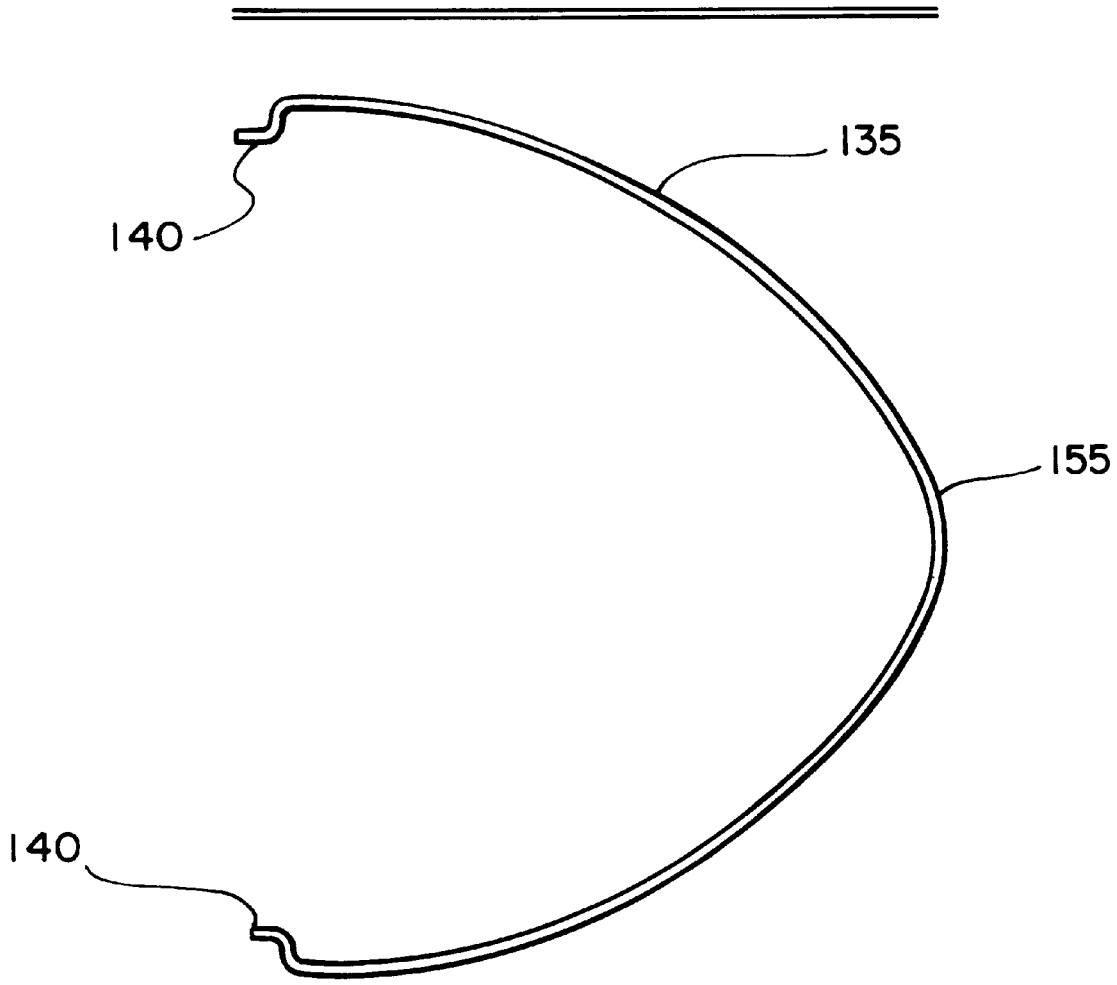
FIG. 2 is a top view of a wireform spring of the fixture of FIG. 1.

Referring also to FIG. 2, a pair of wireform springs 135 serve to secure the reflector in the housing with the trim body snug against the ceiling. Wireform springs 135 are pivotably attached to trim body 130 by mounting ends 140 inserted into holes 145 in the trim body. Wireform springs 135 are slidably installed in a groove 150 on the inside perimeter of housing 110. Only an outer bend 155 of each wireform spring 135 is in contact with housing 110. The outer bend 155 can slide in the groove 150 to rotate the reflector. After installation, the wireform springs 135 are in a compressed state and exert a force that pulls trim body 130 upward against ceiling 105.

Figure 3:
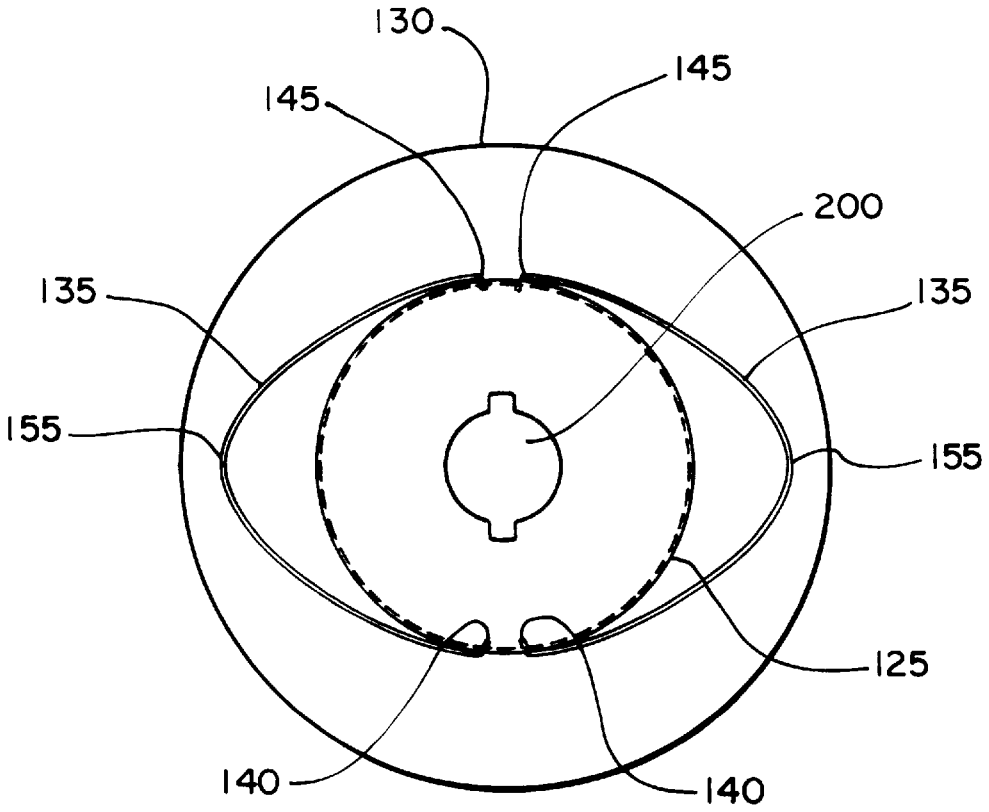
FIGS. 3 and 4 are top and side views of a reflector of the fixture of FIG. 1.
Figure 4:
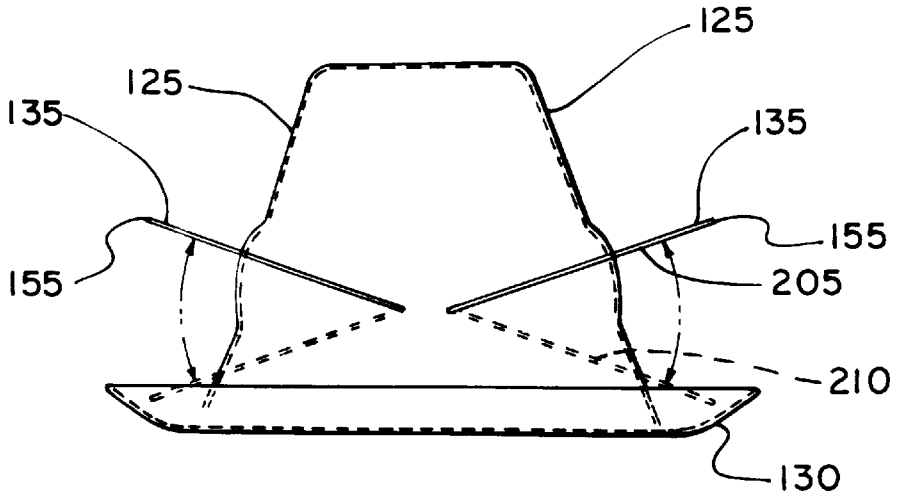

Referring also to FIGS. 3 and 4, reflector 125 includes an opening 200 through which socket 115 passes when reflector 125 is mounted in housing 110. Wireform springs 135, which are pivotably installed in holes 145, can move between a mounting position 205 and an installed position 210. The springs 135 are compressed while moving from the mounting position 205 to the installed position 210. The springs 135 remain in a compressed state when in the installed position 210.

Referring also to FIGS. 5–7, the groove 150 of housing 110 may have an inside diameter that is greater than the inside diameter of housing 110. The groove 150 is defined by a pair of shoulders 300 that retain springs 135 within groove 150. Alternatively, the groove may have an inside diameter less than or equal to the inside diameter of the housing, and may be defined by ridges extending from the inside of the housing.

Figure 8:
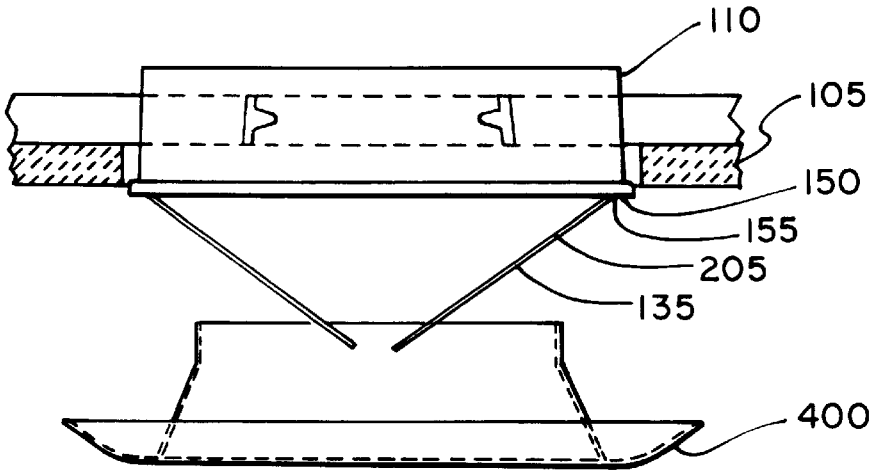
FIGS. 8–10 are front views of the recessed lighting fixture of FIG. 1 with, respectively, wireform springs initially placed in a groove, parallel to the groove, and in the installed position.
Figure 9:
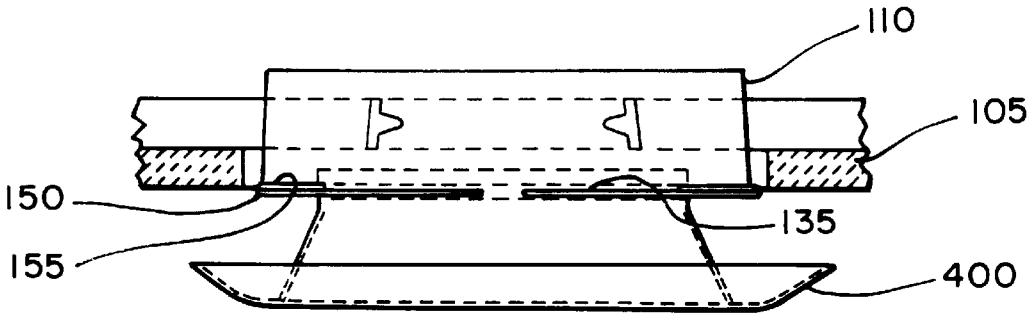
Figure 10:
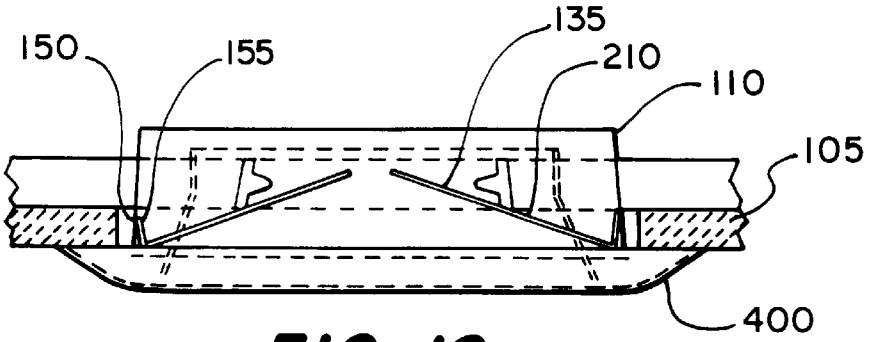

FIGS. 8–10, illustrate the method of installing a trim body 400 into the housing 110 after the housing is mounted in the ceiling 105. Unlike the trim body 130, the trim body 400 includes only a partial reflector 405. However, installation of trim body 400 proceeds in the same way as installation of trim body 130.

Referring to FIG. 8, outer bends 155 of springs 135 are placed in groove 150 in the mounting position 205. Then, referring to FIG. 9, trim body 400 is pushed into housing 110. As trim body 400 is pushed into housing 110, the wireform springs 135 are compressed. At the point in which the springs 135 are parallel to the groove 150, the compression on the springs is the highest. Once the trim body passes this point, expansion of the springs pulls the trim body into the housing. Referring to FIG. 10, when the trim body 400 is seated against the ceiling, the compression in the springs 135 exerts an upward force on the trim body. This force keeps the trim body seated in the housing 110 and against the ceiling.

Figure 11:
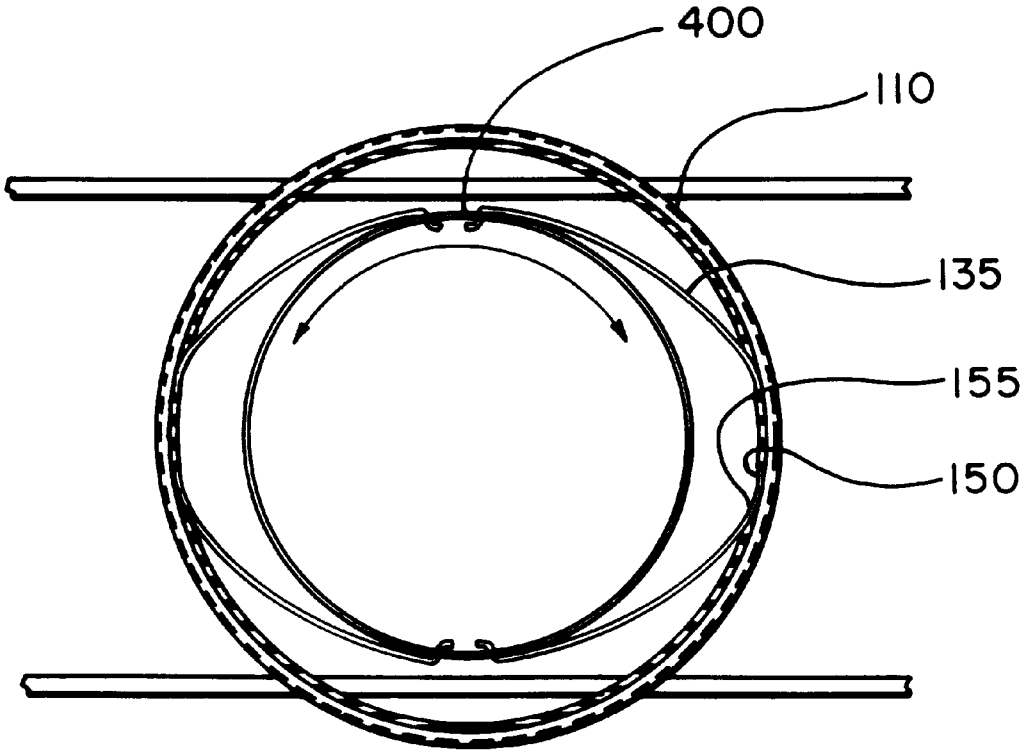
FIG. 11 is a top view of the installed reflector of FIG. 10 illustrating rotation of the reflector relative to the housing.

Referring to FIG. 11, the reflector 125 can rotate in the housing 110 because the only rotation constraint on the trim body is the frictional force between outer bends 155 and groove 150. Thus, the reflector 125 (and trim body 400) can be rotated clockwise and counter-clockwise within housing 110. Such rotation is necessary for trim bodies that are used to direct light or to otherwise affect the pattern of light produced by the fixture.

Figure 12:
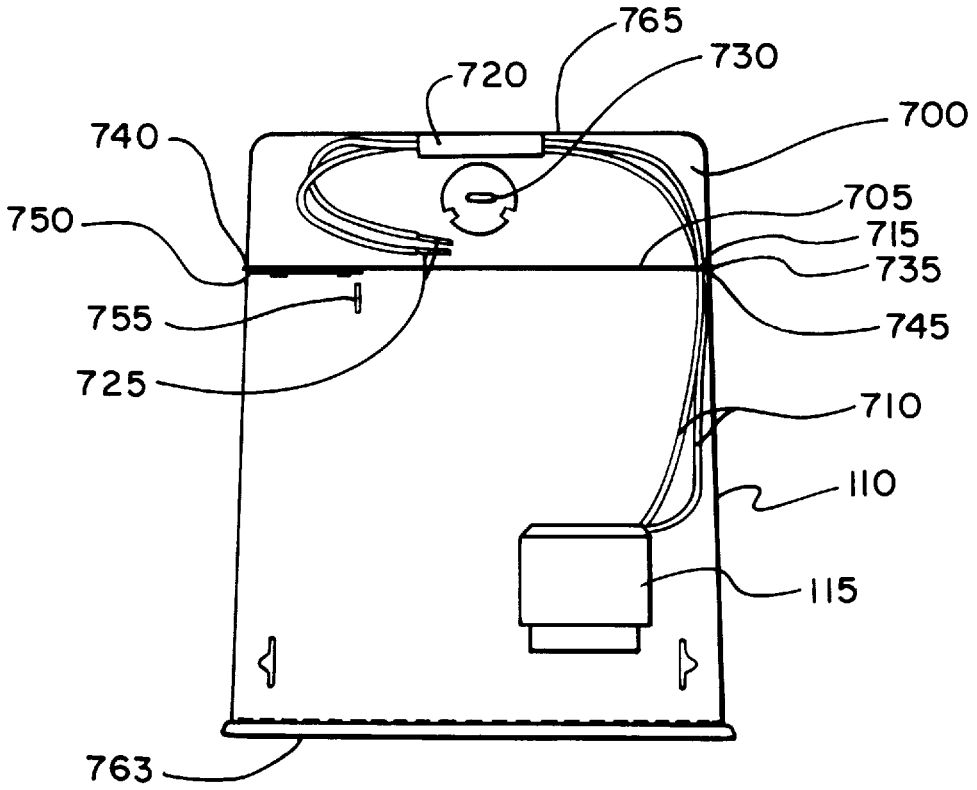
FIGS. 12 and 13 are front and bottom views of the housing illustrating an integral wiring compartment.
Figure 13:
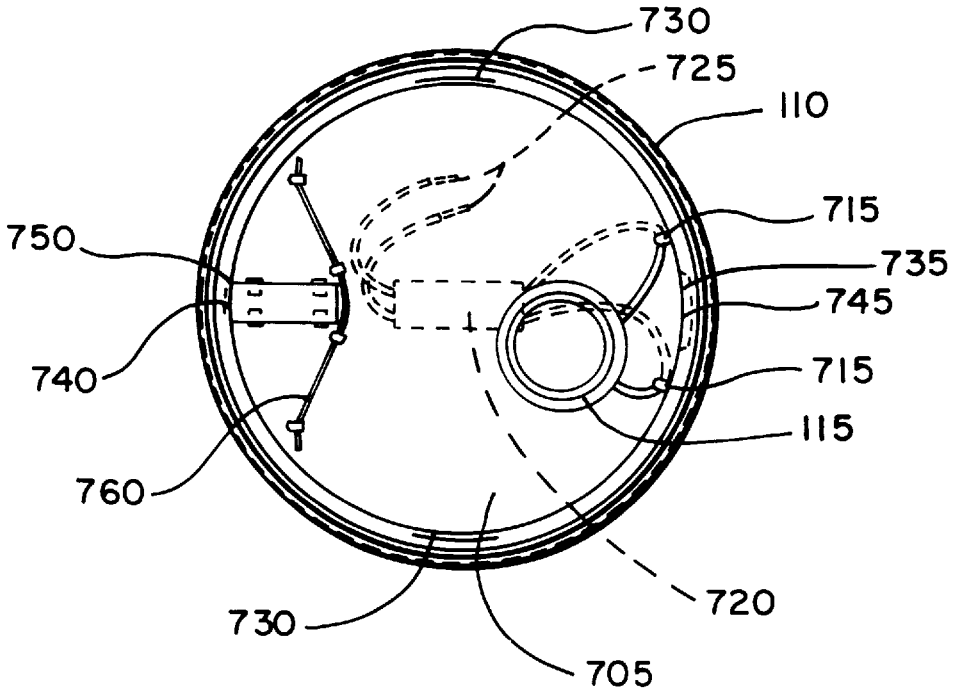

Referring to FIGS. 12 and 13, housing 110 may include an integral wiring compartment 700 that is separated from the remainder of housing 110 by a removable dividing plate 705. A pair of socket wires 710 are connected to socket 115 and pass through a pair of openings 715 in dividing plate 705. One of the socket wires 710 includes a thermal circuit interrupter 720. The socket wires 710 terminate in the wiring compartment at ends 725. Electrical supply wires (not shown) may pass through an opening 730 in housing 110 for connection with the socket wires 710 at the ends 725.

The dividing plate 705 includes a fixed tab 735 and a movable tab 740. Tabs 735 and 740 fit within slots 745 and 750, respectively, on the side of housing 110. Movable tab 740 is attached to a handle 755. A wireform spring 760 is mounted on dividing plate 705 and rests against handle 755 to bias movable tab 740 into slot 750. To remove dividing plate 705 from housing 110, handle 755 is moved toward the center of plate 705, which pulls tab 740 out of slot 750 and releases the plate from the housing.

To connect the socket wires 710 to the supply wires after housing 110 is mounted in the ceiling, a cable including the supply wires is passed through opening 730 and the supply wires are connected to the socket wires 710 at ends 725. Dividing plate 705 then is installed in the housing by pushing handle 755 toward the center of plate 705 while inserting plate 705 in housing 110. Plate 705 can be removed later to make wiring changes or to inspect the wiring. The housing may include additional openings to permit other cables to enter and exit the wiring compartment. The housing also may include a grounding connection to ease attachment of a ground wire of the cable to the housing.

Figure 14:
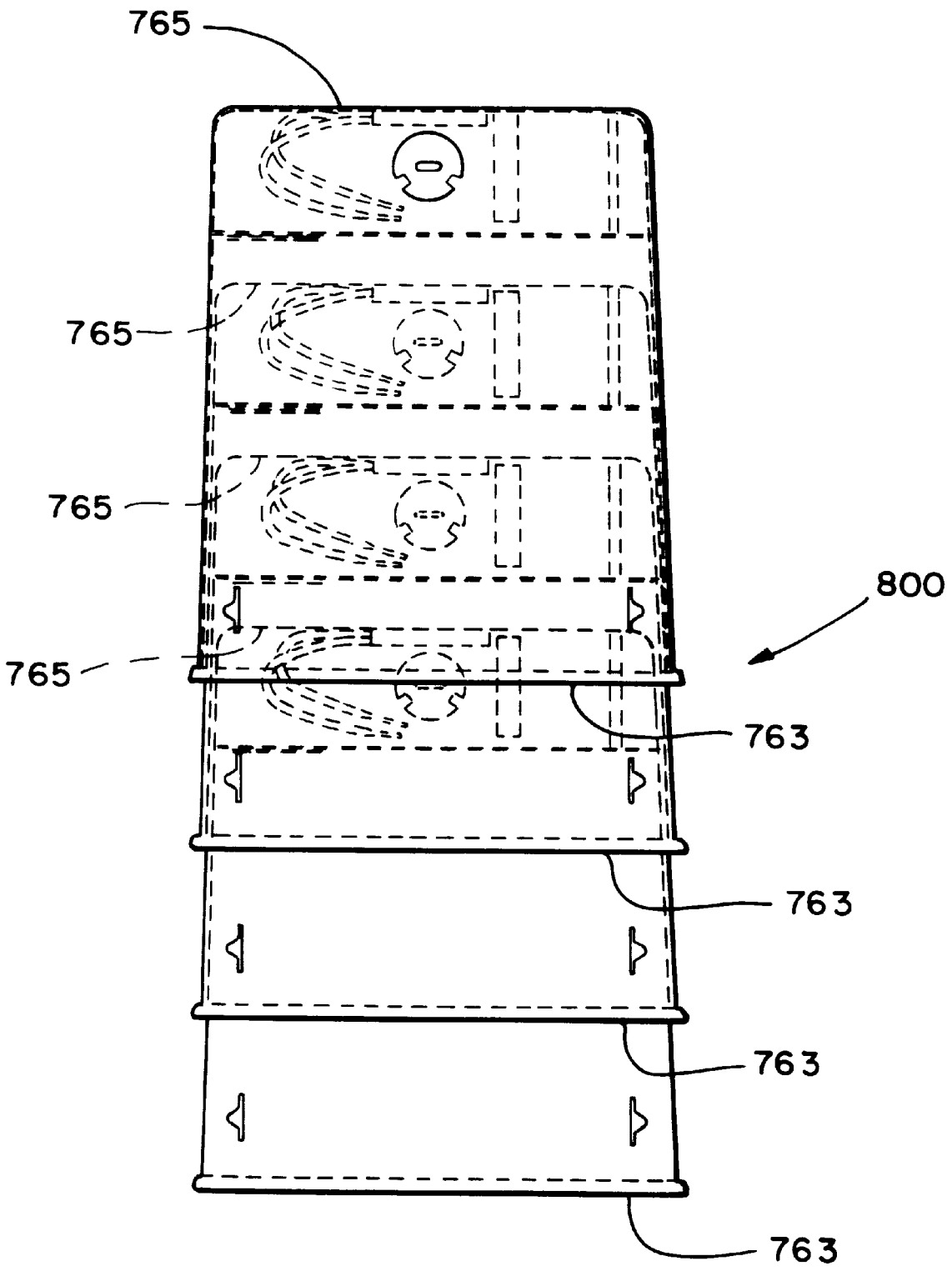
FIG. 14 is a front view of a stack of the housings of FIG. 12.

Referring also to FIG. 14, housing 110 has a tapered shape, with the diameter decreasing from a larger diameter at a wider opening 763 to a smaller diameter at a wiring compartment end 765. Housing 110 also does not have any external projections. Because the opening 763 has a larger diameter than the compartment end 765, end 765 can be inserted into opening 760 to create a stack 800 of multiple housings 110. This permits a large number of housings 110 to be efficiently transported or stored.

Other embodiments are within the scope of the following claims. For example, while the housing with an integral wiring compartment may include a groove for attachment of wireform springs of the trim body 130, of FIG. 1, the housing also may employ conventional trim mounting techniques. Similarly, a fixture using wireform springs for mounting may use a conventional junction box mounted adjacent to, or on the side of, the housing 110.

What is claimed is:

1. A lighting fixture comprising:

a housing having an open end defining an inner groove;

a trim body; and at least one wire form spring pivotally attached to the trim body at two points and having a central portion configured to fit in the groove when the trim body is attached to the housing.

2. The lighting fixture of claim 1, wherein the central portion of the wire form spring includes an outer bend to be slidably installed in the groove.

3. The lighting fixture of claim 1, wherein the wire form spring includes two ends, the trim body includes two holes, and each end of the spring is inserted into one of the holes.

4. The lighting fixture of claim 1, wherein the wire form spring is configured to pivot between a mounting position and an installed position.

5. The light fixture of claim 4, wherein the spring is compressed when moving from the mounting position to the installed position.

6. The light fixture of claim 5, wherein the spring is most compressed at a point between the mounting position and the installed position.

7. The light fixture of claim 5, wherein the spring continues to be compressed in the installed position so that in the compressed spring exerts force pulling the trim body into the housing.

8. The lighting fixture of claim 1, further comprising a light socket located in the housing.

9. The lighting fixture of claim 1, wherein the groove extends along an entire inner perimeter of the open end.

10. The lighting fixture of claim 1, wherein the groove extends along a portion of an inner perimeter of the open end.

11. The lighting fixture of claim 1, wherein the groove has a diameter that is greater than an inside diameter of the housing.

12. The lighting fixture of claim 1, wherein the groove is defined by a pair of shoulders.

13. The lighting fixture of claim 1, wherein the lighting fixture is a recessed lighting fixture.

14. The lighting fixture of claim 1, wherein the housing is generally cylindrical.

15. The light fixture of claim 1, wherein the open end has an irregular shape.

16. A lighting fixture comprising:

a housing having an open end defining an inner groove;

a trim body;

at least one wire form spring attached to the trim body at two points and having a central portion configured to fit in the groove when the trim body is attached to the housing; and a reflector attached to the trim body.

17. The lighting fixture of claim 16, wherein two wire form springs are attached to the trim body and installed in the groove when the trim body is attached to the housing.

18. A lighting fixture comprising:

a housing having an open end defining an inner groove;

a trim body; and at least one wireform spring attached to the trim body at two points and having a central portion configured to fit in the groove when the trim body is attached to the housing, wherein the housing further comprises:

a closed end;

a movable dividing plate positioned between the closed end and the open end to define a light compartment extending from the open end to the plate and a wiring compartment extending from the plate to the closed end; and a release mechanism configured to release the plate to move the plate to permit access to the wiring compartment from the open end.

19. A method of retaining trim in a lighting fixture comprising:

providing a housing having an open end defining an inner groove;

providing a trim body having a wire form spring pivotally attached to the trim body at two points, the wire form spring having a central portion configured to fit in the groove when the trim body is attached to the housing;

placing the central portion of the wire form spring in the groove; and passing the trim body into the housing.

20. The method of claim 19, wherein the trim body includes a reflector.

21. The method of claim 19, wherein the central portion of the wire form spring includes an outer bend, which is slidably installed in the groove.

22. The method of claim 19, further comprising pivoting the wire form spring between a mounting position and an installed position when passing the trim body into the housing.

23. The method of claim 22, further comprising compressing the spring when passing the trim body into the housing.

24. The method of claim 23, wherein the spring continues to be compressed in the installed position so that the compressed spring exerts a force that pulls the trim body into the housing.

25. A lighting fixture comprising:

a generally cylindrical housing having an open end defining an inner groove, a closed end, and a movable plate positioned between the closed end and the open end to define a light compartment extending from the open end to the plate and a wiring compartment extending from the plate to the closed end;

a release mechanism configured to release the plate to move the plate to permit access to the wiring compartment from the open end;

a trim body having a reflector;

a pair of wire form springs, wherein each wire form spring is attached to the trim body at two points, has a central portion including an outer bend configured to be slidably installed in the groove when the trim body is attached to the housing, is configured to pivot between a mounting position and an installed position, and is compressed when moving from the mounting position to the installed position as the trim body is passed into the housing.

* * * * *